US010654099B2

(12) United States Patent
Wang et al.

(10) Patent No.: US 10,654,099 B2
(45) Date of Patent: May 19, 2020

(54) MOLD FOR REDUCING DEFECTS IN LOW PRESSURE CASTING OF ALUMINUM ALLOY WHEEL

(71) Applicant: CITIC DICASTAL CO., LTD, Qinhuangdao, Hebei (CN)

(72) Inventors: Kaiqing Wang, Hebei (CN); Xianyi Xu, Hebei (CN); Changhai Li, Hebei (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 0 days.

(21) Appl. No.: 16/362,141

(22) Filed: Mar. 22, 2019

(65) Prior Publication Data

US 2019/0321878 A1 Oct. 24, 2019

(30) Foreign Application Priority Data

Mar. 23, 2018 (CN) ..... 2018 1 0243371

(51) Int. Cl.
*B22C 9/28* (2006.01)
*B22D 18/04* (2006.01)

(52) U.S. Cl.
CPC ..... *B22C 9/28* (2013.01); *B22D 18/04* (2013.01)

(58) Field of Classification Search
CPC ..... B22C 9/065; B22C 9/28; B22D 18/04
See application file for complete search history.

(56) References Cited

U.S. PATENT DOCUMENTS 5,647,426 A 7/1997 Romulo et al.
5,896,912 A * 4/1999 Monroe ..... B22C 9/28 164/119

FOREIGN PATENT DOCUMENTS

| | | | |
|---|---|---|---|
| CN | 203610645 U | | 5/2014 |
| CN | 105478721 A | * | 4/2016 |
| CN | 105880526 A | | 8/2016 |
| CN | 205851843 U | * | 1/2017 |
| CN | 206605025 U | | 11/2017 |
| CN | 208303843 U | | 1/2019 |

OTHER PUBLICATIONS

EPO machine translation of CN-105478721-A (Year: 2016).*
EPO machine translation of CN-205851843-U (Year: 2017).*

* cited by examiner

*Primary Examiner* — Kevin E Yoon
(74) *Attorney, Agent, or Firm* — IPro, PLLC; Qian Gu

(57) ABSTRACT

A mold for reducing defects in low pressure casting of an aluminum alloy wheel includes a top mold, a side mold and a bottom mold, wherein the top mold is arranged above the bottom mold to mold a back cavity of a wheel, the bottom mold is arranged below the top mold to mold a front wheel disc of the wheel, the side mold is arranged on the side of the top mold and the bottom mold, and the top mold, the side mold and the bottom mold collectively surround a casting cavity of the aluminum alloy wheel, wherein the upper surface of the bottom mold includes a recessed portion configured to form a spoke and a boss portion configured to form a window and wherein the boss portion configured to form the window includes cooling ducts.

9 Claims, 1 Drawing Sheet

MOLD FOR REDUCING DEFECTS IN LOW PRESSURE CASTING OF ALUMINUM ALLOY WHEEL

CROSS REFERENCE TO RELATED APPLICATION

This application claims priority to Chinese Patent Application No. 201810243371.0, entitled MOLD FOR REDUCING DEFECTS IN LOW PRESSURE CASTING OF ALUMINUM ALLOY WHEEL and filed on Mar. 23, 2018, which is incorporated herein by reference for all purposes.

FIELD OF THE INVENTION

The present invention relates to the field of casting, and specifically, relates to a low pressure casting mold structure for an aluminum alloy wheel.

BACKGROUND OF THE INVENTION

In the low pressure casting production of aluminum alloy wheels, shrinkage and pores are two common casting defects, resulting in up to 80% of the total waste. When high-temperature molten aluminum is filled, the entire mold is in an open atmosphere. If the air in the cavity cannot be removed smoothly, the air will gather at the distal rim of a casting and be finally wrapped in the molten aluminum, cannot escape during solidification, and therefore forms pores. The pores have the hazards of reducing the effective cross-sectional area of the product and reducing the safety performance of the rim. The root R angles at the junctions of spoke and the rim are obvious casting hot spots, the front spoke acts as a feeding channel, and sufficient heat is required during solidification to maintain the smoothness of the passage so as to powerfully feed the hot spots. The spoke should be maintained at a relatively high temperature, otherwise, the defects of shrinkage, porosity and the like easily occur at the R angles. At the same time, the low solidification rate causes coarse internal grains and loose structure of the casting to damage the mechanical properties of the casting, so that the casting cannot meet the strict requirements of customers.

In actual production, the above problems have seriously affected the forming quality of wheel castings and reduced the yield. Therefore, certain measures need to be taken for optimization and improvement to solve the problems of pores, shrinkage, coarse grain and the like of the castings, so as to achieve high-quality production of wheels.

SUMMARY OF THE INVENTION

The present invention is directed to solve the deficiencies in the prior art and to propose an improved low pressure cast aluminum alloy wheel mold structure.

A mold for reducing defects in low pressure casting of an aluminum alloy wheel, the mold comprising a top mold, a side mold and a bottom mold, the top mold being arranged at the top to mold a back cavity of a wheel, the bottom mold being arranged below the top mold to mold a front wheel disc of the wheel, the side mold being arranged on the side of the top mold and the bottom mold, and the top mold, the side mold and the bottom mold collectively surrounding a casting cavity of the aluminum alloy wheel, characterized in the upper surface of the bottom mold comprises a recessed portion for forming a spoke and a boss portion for forming a window, and the top mold has a depth such that a hub cavity is 1-2 mm higher than a predetermined hub blank; the portion of the top mold that cooperates with the boss portion of the upper surface of the bottom mold for forming the window comprises an assembly slot, the assembly slot is expanded by 2-3 mm based on the boss portion, and a clearance of 0.2-0.5 mm is formed between the top surface of the assembly slot and the boss portion; and the boss portion for forming the window comprises cooling ducts.

In one aspect of the present invention, the back surface of the bottom mold is a rotator cavity formed by turning, and the wall thickness of the bottom mold is 20-25 mm.

In one aspect of the present invention, the cooling ducts are round holes penetrating the bottom mold.

In one aspect of the present invention, the round holes have the diameter of 3-5 mm and are spaced apart from each other by 3-6 mm.

In one aspect of the present invention, the round holes have the diameter of 4 mm and are spaced apart from each other by 4 mm.

In one aspect of the present invention, exhaust pipes are welded to two ends of the round holes.

In one aspect of the present invention, the boss portion for forming the window does not have round holes at the edge within a range of 5 mm.

BRIEF DESCRIPTION OF THE DRAWINGS

The embodiments of the present invention will be described in detail below in combination with the accompanying drawings, in which.

In which: 1-top mold; 11-assembly slot; 2-side mold; 3-bottom mold; 31-boss portion; 32-cooling cavity; 33-profiling slot; 34-air outlet; 4-thermal insulation asbestos; 5-thin iron sheet; 6-exhaust pipe.

DETAILED DESCRIPTION OF EMBODIMENTS

Figure 1:
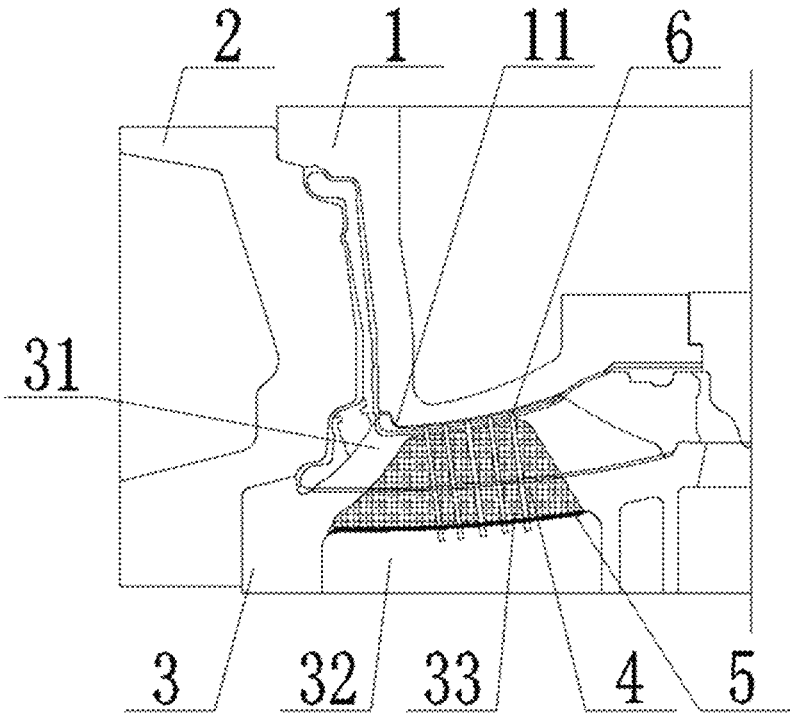
FIG. 1 is a structure diagram of a low pressure cast aluminum alloy wheel mold structure according to the present invention.
Figure 2:
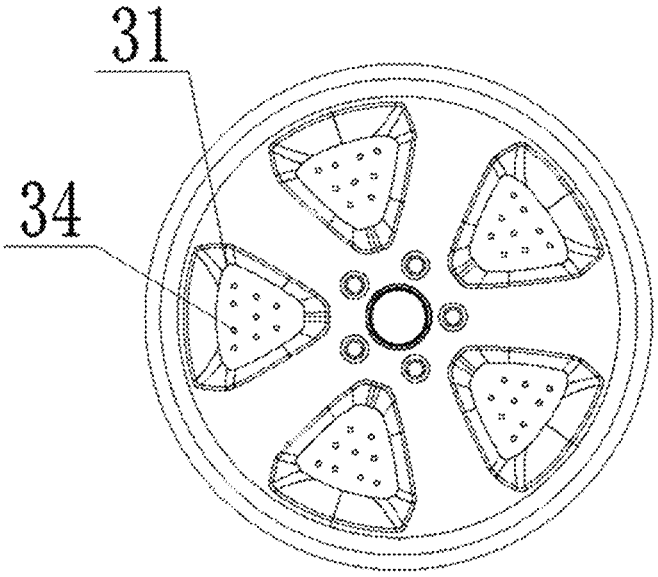
FIG. 2 is a structure diagram of a bottom mold according to the present invention.

FIG. 1 and FIG. 2 disclose an improved low pressure cast aluminum alloy wheel mold structure in the present invention, including a top mold (1), a side mold (2), a bottom mold (3), thermal insulation asbestos (4), a thin iron sheet (5), and exhaust pipes (6).

The top mold (1) is arranged at the top to mold a back cavity and an inner rim of a wheel; the bottom mold (3) is arranged below the top mold (1) to ensure the front shape of the wheel; the side mold (2) is arranged between the top mold (1) and the bottom mold (3) to mold an outer rim; and the three together form a cavity of a wheel casting, and ensure the precise and smooth molding of the product.

The front shape of the wheel is divided into two parts: spoke and a window. In order to mold a window, the bottom mold (1) is designed with a boss structure (31), the side of which is consistent with the shape of the product and the top contour of which is higher than the back cavity machining line by 1-2 mm; and the top mold (1) should be correspondingly machined with an assembly slot (11), the side of which is expanded 2-3 mm on the basis of the boss (31) and the top of which is spaced apart from the boss by a fit clearance of 0.2-0.5 mm without contacting.

In order to arrange cooling ducts, the back of the bottom mold (3) is machined into a cavity structure (32), which can be machined into a rotator by turning to reduce the manufacturing time and lower the production cost. The wall thickness from the bottom surface to the front side of the cavity (32) is designed to be 20-25 mm to ensure sufficient heat absorption capacity of the mold.

The back of the bottom mold boss portion (31) is machined with a profiling slot (33), the side wall thickness of which is determined according to the width of the spoke, generally 15-20 mm; to ensure uniform wall thickness, the profiling slot (33) is preferentially manufactured by milling; the top wall thickness of the profiling slot (33) is designed to be 3-6 mm to reduce the heat absorption of the mold and ensure the use strength of the mold; the internal connecting surfaces of the profiling slot are in smooth transition, with chamfers R of 5-8 mm; and the profiling slot (33) is filled with thermal insulation asbestos (4) or other thermal insulation material, and welded and sealed with the thin iron sheet (5) to form a closed thermal insulation cavity so as to reduce the loss of heat in the mold.

The top surface of the bottom mold boss (31) is machined with through small round holes (34) having the diameter ϕ of 3-5 mm, the holes are uniformly distributed at intervals of 4 mm, and the specific number of the holes is determined according to the size of the top surface; the outermost small holes should be spaced apart from the edge of the boss by more than 5 mm to prevent the inflow of high-temperature molten aluminum to block the holes; and the exhaust pipes (6) are welded on the small holes and have the outer diameter consistent with the diameter of the holes, the parts of the exhaust pipes (6) protruding the top surface should be smoothed to avoid affecting the closure of the mold, and the bottoms of the exhaust pipes (6) extend out of the iron sheet to communicate with the atmosphere so as to ensure the smooth discharge of the air in the cavity.

The profiling assembly slot is machined at the back cavity of the bottom mold opposite to the window boss to weaken the heat absorption capacity of thick cold iron; the slot is filled with the thermal insulation material to further prevent the heat loss of the mold, delay the cooling of the spoke, and ensure smooth molten aluminum feeding on the hot spots; and the boss is machined with small holes and welded with exhaust pipes to effectively connect the cavity with the external environment, increase the exhaust area, and create a cleaner mold environment for molten aluminum filling solidification.

The invention claimed is:

1. A mold for reducing defects in low pressure casting of an aluminum alloy wheel, the mold comprising a top mold, a side mold and a bottom mold, the top mold being arranged at the top to mold a back cavity of a wheel, the bottom mold being arranged below the top mold to mold a front wheel disc of the wheel, the side mold being arranged on the side of the top mold and the bottom mold, and the top mold, the side mold and the bottom mold collectively surrounding a casting cavity of the aluminum alloy wheel, characterized in that the upper surface of the bottom mold comprises a recessed portion for forming spokes and a boss portion for forming a window;

the top mold has a depth such that a hub cavity is 1-2 mm higher than a predetermined hub blank;

the portion of the top mold that cooperates with the boss portion of the upper surface of the bottom mold for forming the window comprises an assembly slot, the assembly slot extends 2-3 mm outwards from the boss portion, and a clearance of 0.2-0.5 mm is formed between the top surface of the assembly slot and the boss portion;

the boss portion for forming the window comprises cooling ducts; and the back of the boss portion of the bottom mold is machined with a profiling slot, the profiling slot is filled with thermal insulation material.

2. The mold for reducing defects in low pressure casting of an aluminum alloy wheel according to claim 1, characterized in that the back surface of the bottom mold is a rotator cavity formed by turning, and the wall thickness of the bottom mold is 20-25 mm.

3. The mold for reducing defects in low pressure casting of an aluminum alloy wheel according to claim 1, characterized in that the cooling ducts are round holes penetrating the bottom mold.

4. The mold for reducing defects in low pressure casting of an aluminum alloy wheel according to claim 3, characterized in that the round holes have the diameter of 3-5 mm and are spaced apart from each other by 3-6 mm.

5. The mold for reducing defects in low pressure casting of an aluminum alloy wheel according to claim 3, characterized in that the round holes have the diameter of 4 mm and are spaced apart from each other by 4 mm.

6. The mold for reducing defects in low pressure casting of an aluminum alloy wheel according to claim 3, characterized in that exhaust pipes are welded to two ends of the round holes.

7. The mold for reducing defects in low pressure casting of an aluminum alloy wheel according to claim 3, characterized in that the boss portion for forming the window does not have round holes at the edge within a range of 5 mm.

8. The mold for reducing defects in low pressure casting of an aluminum alloy wheel according to claim 1, characterized in that the profiling slot is welded and sealed with a thin iron sheet to form a closed thermal insulation cavity.

9. The mold for reducing defects in low pressure casting of an aluminum alloy wheel according to claim 8, characterized in that the cooling ducts are round holes penetrating the bottom mold, exhaust pipes are welded to two ends of the round holes, parts of the exhaust pipes protruding the top surface are smoothed, and bottoms of the exhaust pipes extend out of the thin iron sheet.

* * * * *